US010667331B2

(12) United States Patent
Iida et al.

(10) Patent No.: US 10,667,331 B2
(45) Date of Patent: May 26, 2020

(54) HEATING TAPE

(71) Applicant: NICHIAS CORPORATION, Tokyo (JP)

(72) Inventors: Kenji Iida, Tokyo (JP); Yoshiyuki Motoyoshi, Tokyo (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 15/022,096

(22) PCT Filed: Sep. 3, 2014

(86) PCT No.: PCT/JP2014/004514
§ 371 (c)(1),
(2) Date: Mar. 15, 2016

(87) PCT Pub. No.: WO2015/045279
PCT Pub. Date: Apr. 2, 2015

(65) Prior Publication Data

US 2016/0227608 A1 Aug. 4, 2016

(30) Foreign Application Priority Data

Sep. 30, 2013 (JP) ..... 2013-205693

(51) Int. Cl.
*H05B 3/56* (2006.01)
*H05B 3/34* (2006.01)
(Continued)

(52) U.S. Cl.
CPC ..... *H05B 3/565* (2013.01); *H05B 1/0288* (2013.01); *H05B 3/34* (2013.01); *H05B 3/58* (2013.01)

(58) Field of Classification Search
CPC . H05B 3/565; H05B 3/34; H05B 3/58; H05B 3/342; H05B 3/345; H05B 3/347;
(Continued)

(56) References Cited

U.S. PATENT DOCUMENTS 3,953,566 A * 4/1976 Gore ..... B01D 71/36 264/505
3,962,153 A 6/1976 Gore
(Continued)

FOREIGN PATENT DOCUMENTS

GB 2065430 A 6/1981
JP 51-18991 6/1976
(Continued)

OTHER PUBLICATIONS

Office action issued in corresponding Korean application 10-2016-7002563 dated May 19, 2017 (no translation available, submitted for certification).
(Continued)

*Primary Examiner* — Shawntina T Fuqua
(74) *Attorney, Agent, or Firm* — Nixon & Vanderhye P.C.

(57) ABSTRACT

A tape heater for keeping warm or heating an object by deforming its shape to conform to contours of the object, which comprises: a heating element; and an outer covering member that envelops and accommodates the heating element and that is composed of a porous sheet made of a resin which has a melting point of 300° C. or higher. Provided is a tape heater that deforms to conform to the contours of an object to be kept warm or the like after being placed on the object and changes its shape that has been deformed as little as possible.

7 Claims, 4 Drawing Sheets

(51) Int. Cl.
*H05B 3/58* (2006.01)
*H05B 1/02* (2006.01)

(58) Field of Classification Search
CPC ... H05B 3/54; H05B 3/06; H05B 3/36; H05B 3/46; H05B 3/48; H05B 3/64; H05B 3/76; H05B 2203/013; H05B 2203/017; H05B 2203/036; H05B 2203/014; H05B 2203/012; H05B 2203/015; H05B 2203/021; H05B 2203/022; H05B 1/0288
See application file for complete search history.

(56) References Cited

U.S. PATENT DOCUMENTS

| | | | | |
|---|---|---|---|---|
| 4,096,227 | A | 6/1978 | Gore | |
| 4,187,390 | A | 2/1980 | Gore | |
| 4,497,760 | A * | 2/1985 | Sorlien | B29C 65/18 156/86 |
| 8,123,839 | B2 | 2/2012 | Abe et al. | |
| 8,147,911 | B2 | 4/2012 | Okuda et al. | |
| 8,592,725 | B1 * | 11/2013 | Hunger | H05B 3/34 219/211 |
| 2004/0188419 | A1 * | 9/2004 | Fukuda | H05B 3/34 219/549 |
| 2005/0067038 | A1 | 3/2005 | Kobayashi et al. | |
| 2006/0141159 | A1 | 6/2006 | Okuda et al. | |
| 2009/0277141 | A1 | 11/2009 | Abe et al. | |
| 2013/0062338 | A1 | 3/2013 | Iida et al. | |
| 2014/0183180 | A1 | 7/2014 | Watakabe et al. | |

FOREIGN PATENT DOCUMENTS

| | | | |
|---|---|---|---|
| JP | 61-113399 | U | 7/1986 |
| JP | 1-14679 | B2 | 3/1989 |
| JP | 11-74066 | A | 3/1999 |
| JP | 11-102773 | A | 4/1999 |
| JP | 11-135236 | A | 5/1999 |
| JP | 11-149978 | A | 6/1999 |
| JP | 11-176562 | A | 7/1999 |
| JP | 2004-303580 | A | 10/2004 |
| JP | 2005-071930 | A | 3/2005 |
| JP | 2005-188677 | A | 7/2005 |
| JP | 2008-293870 | A | 12/2008 |
| KR | 2005-0031904 | A | 4/2005 |
| KR | 20-0411842 | Y1 | 3/2006 |
| KR | 101264588 | B1 | 5/2013 |
| TW | 200502084 | A | 1/2005 |
| TW | 200946576 | A1 | 11/2009 |
| WO | 2011/126051 | A1 | 10/2011 |
| WO | 2012/144586 | A1 | 10/2012 |

OTHER PUBLICATIONS

English translation of the Written Opinion of the International Searching Authority issued in corresponding application PCT/JP2014/004514 dated Apr. 5, 2016.
International Search Report issued in corresponding application PCT/JP2014/004514 completed on Nov. 11, 2014 and dated Nov. 18, 2014.
Office Action issued in related Taiwanese application 103131910 dated Aug. 24, 2016 (no translation available, submitted for certification).
Office Action issued in co-pending Korean application 10-2016-7002563 dated May 2, 2018 (no translation available; submitted for certification).

* cited by examiner

HEATING TAPE

CROSS-REFERENCE TO RELATED APPLICATIONS

This is a National Phase Application in the United States of International Patent Application No. PCT/JP2014/004514 filed Sep. 3, 2014, which claims priority on Japanese Patent Application No. 2013-205963, filed Sep. 30, 2013. The entire disclosures of the above patent applications are hereby incorporated by reference.

The present invention relates to a tape heater.

BACKGROUND ART

For example, the cited document 1 discloses a heating element unit in which heater wires are arranged between at least two sheets of base cloths that are laid on each other, at least two base cloths are joined by a plurality of jointing wires that are parallel to each other, and the heater wire is arranged so as to pass through between the joining wires.

The cited document 2 discloses a tape heater in which a heating element unit is supported on a heating surface on a belt-like base member having heat resistance and flexibility and the entire part thereof is covered by a covering layer composed of a heat-resistant resin sheet.

RELATED ART DOCUMENTS

Patent Documents

Patent Document 1: JP-A-2005-71930
Patent Document 2: JP-A-2004-303580

SUMMARY OF THE INVENTION

Problems to be Solved by the Invention

An object that is kept warm or heated by a tape heater is, for example, a pipe, a flange, a joint, a valve or the like that internally accommodates a liquid or a gas that is required to be heated or kept warm at a prescribed temperature. As for the tape heater according to the present invention, the tape heater is placed in adjacent to the objects by winding around or placing along therewith in conformity with the contours of the object.

A tape heater is required to be flexible in order to allow deforming the shape of own to conform to the contours of various objects to be kept warm or the like. Therefore, it is preferred that the outer covering member that constitutes the tape heater be formed of a material having high flexibility. Further, since there may be a case that the object is required to be kept warm at a temperature of about 150° C., in order to respond to such a demand, the covering member constituting the tape heater is required to have a certain heat resistance.

On the other hand, as for the tape heater placed in adjacent to the object, once it is placed, it is preferable that the shape that has been deformed to conform to the contours of the object be changed as little as possible. If the shape thereof that has been once deformed to conform to the contours of the object changes to other shapes, an unnecessary gap is formed between the tape heater and the object, and as a result, efficiency in keeping warm or the like the object is lowered.

Under such circumstances, the inventors thought as follows: when being placed on an object, the tape heater is required to be flexible in order to deform the shape thereof to conform to the shape of the object. However, after being placed on the object, the tape heater is required to retain its shape that has been deformed to conform to the shape of the object such that the state of placement is not changed.

The present invention relates to a tape heater that keeps warm or the like of an object, and aims to provide a tape heater that can deform the shape thereof to conform to the contours of the object, and hence can be placed easily in adjacent to an object, and after being placed, changes its shape that has been deformed to conform to the contours of the objects as little as possible.

Means for Solving the Problems

The tape heater according to the present invention to dissolve the above-mentioned problem is a tape heater that deforms the shape thereof to conform to the contours of an object and keeps warm or heats the object, which comprises:

a heating element, and an outer covering member that envelops and accommodates the heating element and that is composed of a porous sheet made from a resin material having a melting point of 300° C. or higher.

Also, the porous sheet may be formed by stretching a resin sheet to form a plurality of pores. Also, the porous sheet may be made of polytetrafluoroethylene (PTFE).

Also, a metal thin film may be further included between the heating element and the porous sheet. Also, the metal thin film may be provided between the object provision side of the heating element and the porous sheet and between the side opposite to the object provision side and the porous sheet.

Further, when provided on the object to conform to the contours of the object to be kept warm or heated, a shape of the outer covering member that has been deformed to conform to the contours of the object, is retained by heat generated by the heating element.

Advantageous Effects of the Invention

According to the invention, the present invention provides a tape heater that can be placed easily in adjacent to an object by deforming the shape thereof to conform to the contours of the object, and, after being placed, changes the shape that has been deformed to conform to the contours of the object as little as possible.

MODE FOR CARRYING OUT THE INVENTION

The tape heater according to the present invention is a tape heater that deforms the shape thereof to conform to the contours of an object and keeps warm or heats the object, which comprises a heating element and an outer covering member that envelops and accommodates the heating element and that is composed of a porous sheet made of a resin material having a melting point of 300° C. or higher. Further, the tape heater according to the present invention may be a tape heater that deforms the shape thereof to conform to the contours of the object, and keeps warm or heats the object by being placed in adjacent to the object.

Here, an object to be kept warm or heated by the tape heater includes, for example, a pipe, a flange, a joint, a valve or the like which internally accommodates a liquid or a gas that is required to be heated or kept warm at a prescribed temperature. The tape heater according to the present invention is placed in adjacent to the object by winding around or placing along in conformity with the contours of these objects.

The tape heater is required to be flexible in order to deform its shape to conform to the contours of various objects to be kept warm or the like. Therefore, it is preferred that the outer covering member constituting the tape heater is formed f a highly flexible material. Further, there is the case where the object is required to be kept warm or the like at around 150° C., the outer covering member constituting the tape heater is required to have a prescribed heat resistance in order to fulfill such requirement.

On the other hand, it is preferred that the tape heater that is placed in adjacent to an object change its shape that has been deformed to conform to the contours of the object as little as possible once it is placed. If the shape of the tape heater that has been deformed to conform to the contours of the object changes to other shapes, an unnecessary gap is generated between the tape heater and the object, and as a result, efficiency in keeping warm or the like the object is lowered.

Therefore, while the tape heater is required to be flexible when being placed on an object in order to deform itself to conform to the contours of the object, after being placed on the object once, the tape heater is required to retain its shape that has been fitted to the shape of the object in order not to change the state of placement. In order to realize a tape heater having properties that differ contrarily to each other in accordance with the state of use, the inventors made intensive studies. As a result, the inventors have achieved at the tape heater of the present invention.

Figure 1:
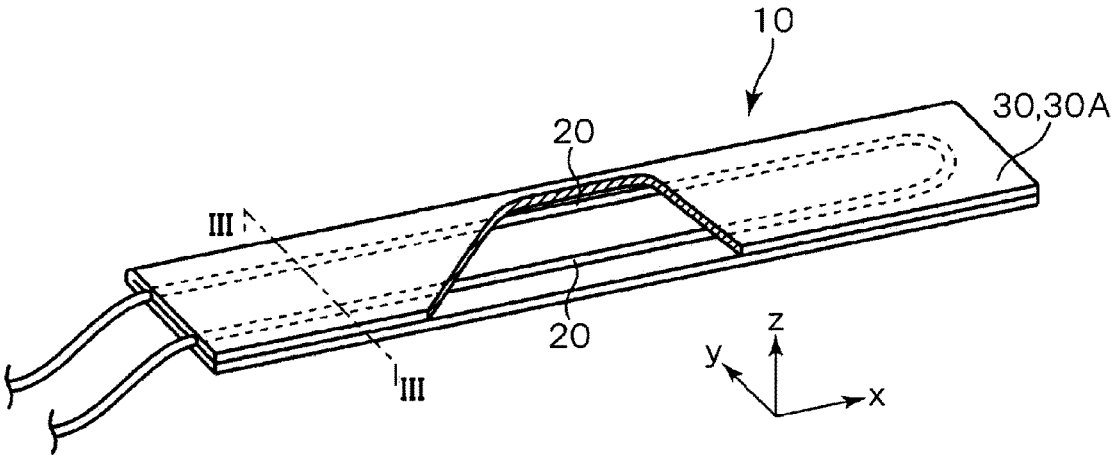
FIG. 1 is a partially cut-away perspective view of the tape heater according to the present invention.

Hereinbelow, a detailed explanation will be made on the tape heater according to the present invention with reference to the drawings. FIG. 1 is a partially cut-way perspective view of the tape heater according to the present invention. As shown in FIG. 1, a tape heater 10 according to the present invention comprises a heating element 20 and an outer covering member 30 that envelops and accommodates the heating element 20 and that is composed of a porous sheet 30A made of a resin material having a melting point of 300° C. or higher.

Figure 4:
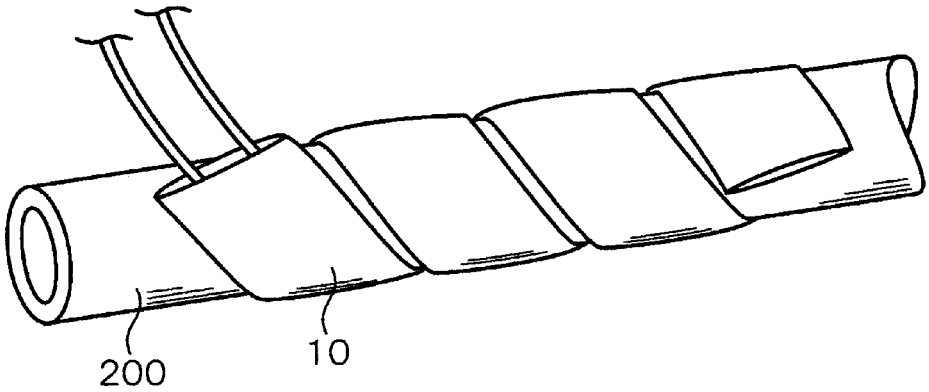
FIG. 4 is a view showing a state in which the tape heater shown in FIG. 1 deforms its shape to conform to the contours of the object and keeps warm or heats the object.

FIG. 4 is a view showing a state in which the tape heater shown in FIG. 1 deforms its shape to conform to the contours of the object and keeps warm or heats the object. In FIG. 4, the object to be kept warm or the like is a pipe (straight pipe), and the tape heater 10 deforms its shape to conform to the contours of the object 200 and is placed in adjacent to the object 200. More specifically, in FIG. 4, the tape heater 10 is wound around a pipe (straight pipe) that is an object to be kept warm or the like.

The heating element 20 that constitutes the tape heater 10 according to the present invention is realized by an electric heater wire, for example. While the above-mentioned electric heater wire is not particularly limited, it may be a nichrome wire or a SUS wire. The power consumption the electric heater wire is appropriately set in accordance with the application of the tape heater 10 of the present invention. Normally, the power consumption may be 10 to 500 W.

In respect of safety and durability, the outer peripheral part of the electric heater wire may be covered by a protective material such as a heat-resistant and electrically insulating material. Although the protective material is not particularly limited, silica sleeve or cloth, alumina sleeve or cloth, glass sleeve or cloth or the like can be given. Among these, silica sleeve can be used safely. Here, the heating element 20 includes a planar heater formed in the shape of a plane or the like. Any heating element may be used as long as it generates heat utilizing resistance heating.

In the tape heater 10 shown in FIG. 1, a single electric heater wire as the heating element 20 is accommodated within the outer covering member 30. The electric heater wire enters the inside of the outer covering member 30 from one end of the outer covering member 30, makes a U-turn at the other end of the outer covering member 30, and is taken out of the outer covering member 30 again from the one end of the outer covering member 30. In the tape heater 10 shown in FIG. 1, the electric heater wire makes only a single U-turn in the inside of the outer covering member 30. The electric heater wire may have a structure in which the electric heater wire makes repeated U-turns at the both ends of the outer covering member 30.

The electric heater wire that the parts thereof are arranged side by side by making a U-turn as explained above is provided such that they do not contact with each other in the inside of the outer covering member 30.

Subsequently, an explanation will be given on the outer covering member 30 used in the tape heater 10 according to the present invention. The most significant feature of the tape heater 10 according to the present invention is that a porous sheet 30A made of a resin material having a melting point of 300° C. or higher is used as the outer covering member 30.

The tape heater 10 according to the present invention is supposed to heat or keep warm an object at a temperature around 100 to 200° C. Hence, the heating element 20 provided in the tape heater 10 can generate heat at a temperature of 200° C. or higher and up to around 300° C. Therefore, the porous sheet 30A constituting the outer covering member 30 of the tape heater 10 according to the present invention has a melting point of 300° C. or higher.

Also, the porous sheet 30A constituting the outer covering member 30 of the tape heater 10 according to the present invention may have a melting point of 310° C. or higher. Here, there is no particular limitation of the upper limit of the melting point of the porous sheet 30A constituting the outer covering member 30 constituting the tape heater 10 according to the present invention, but it may be 400° C. or lower, for example.

Figure 2A:
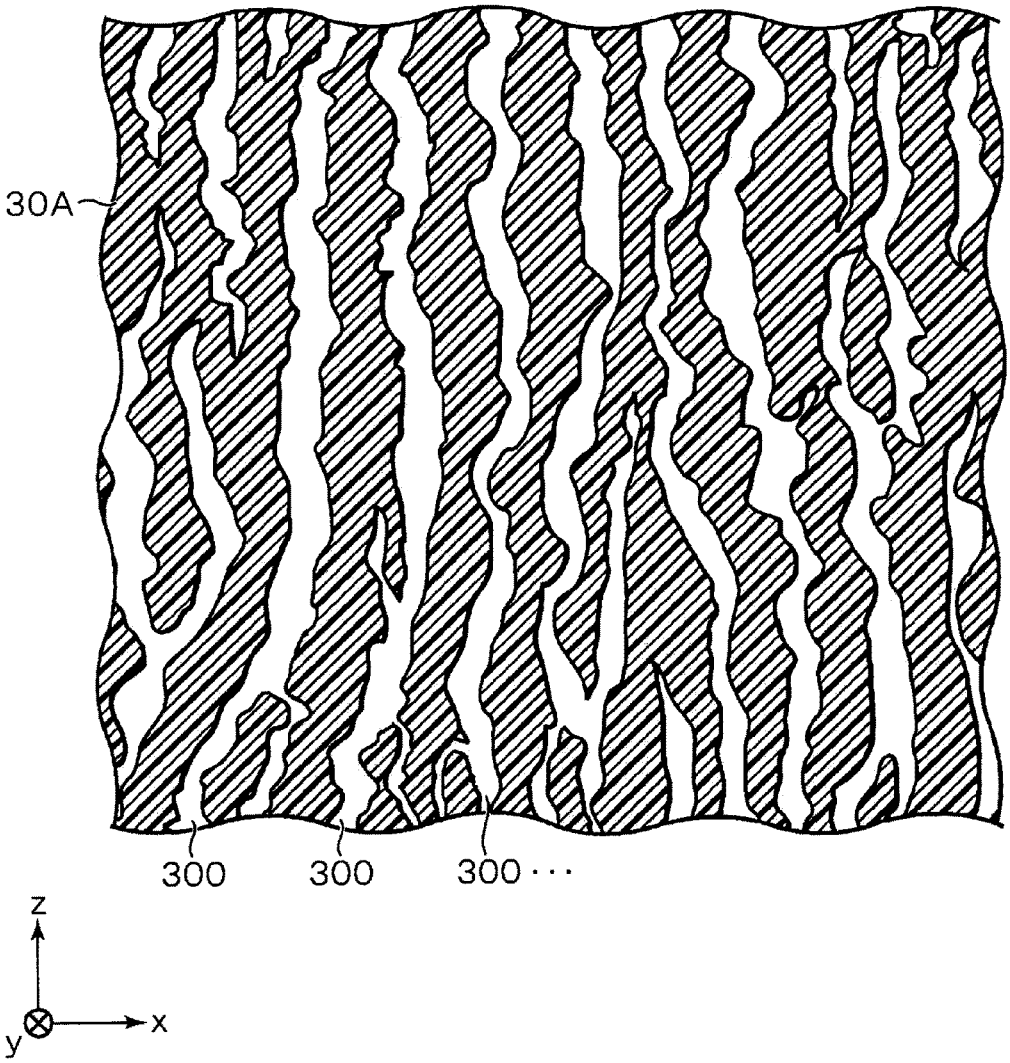
FIG. 2A is a partially enlarged view of a cross section of the porous sheet that constitutes the outer covering member of the tape heater of the present invention and is made from a resin material having a melting point of 300° C. or higher, showing a state in which the tape heater is placed on an object but has not yet been used by heating.

FIG. 2A is a partially enlarged view of a cross section of the porous sheet 30A that constitutes the outer covering member 30 of the tape heater 10 according to the present invention and is made of a resin material having a melting point of 300° C. or higher, showing a previous state in which the tape heater 10 is placed on an object and the tape heater 10 has been used and heated.

Figure 2B:
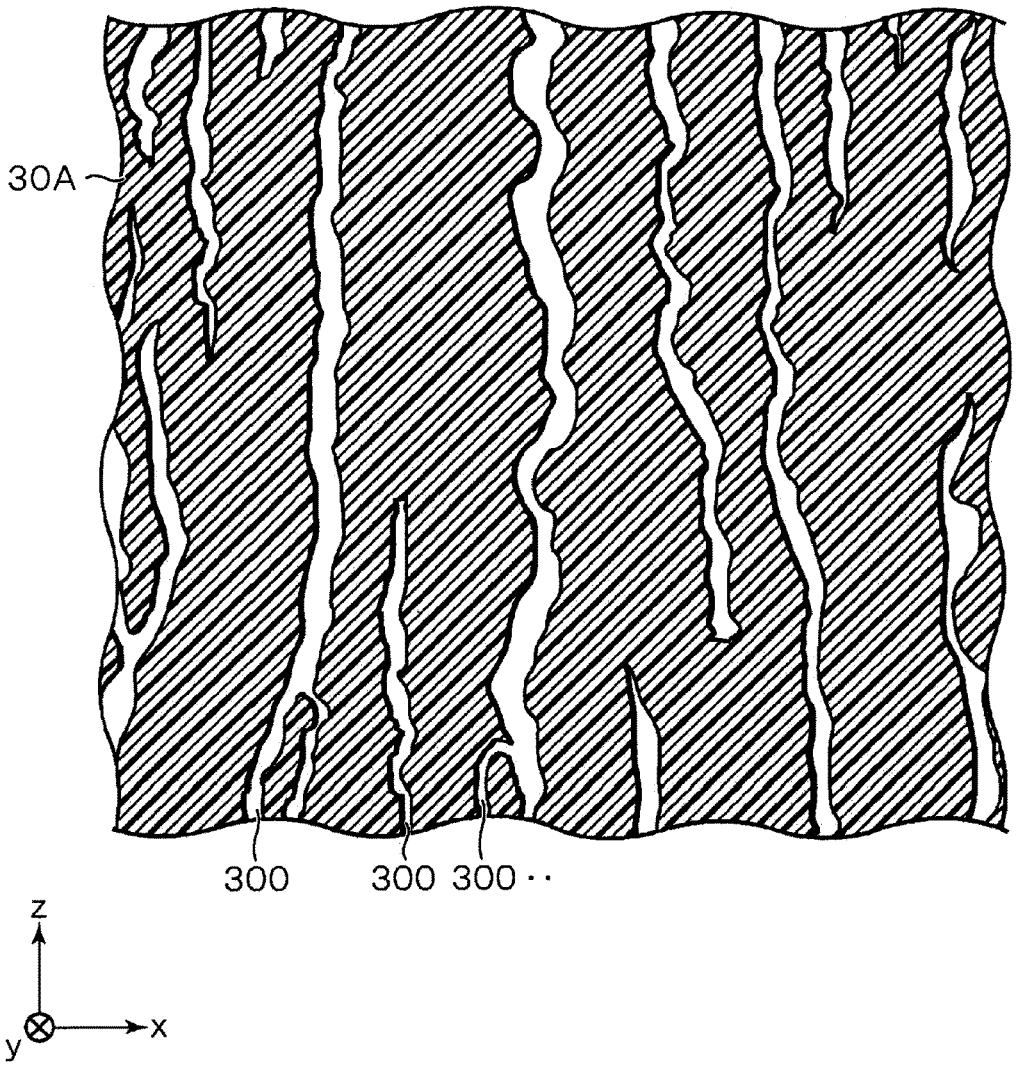
FIG. 2B is a partially enlarged view of a cross section of the porous sheet that constitutes the outer covering member of the tape heater of the present invention and is made from a resin material having a melting point of 300° C. or higher, showing a state in which the tape heater is placed on an object and has been used by heating.

FIG. 2B is a partially enlarged view of a cross section of the porous sheet 30A that constitutes the outer covering member 30 of the tape heater 10 according to the present invention and is made of a resin material having a melting point of 300° C. or higher, showing a state in which the tape heater 10 is placed on an object and the tape heater 10 has been used and heated.

The cross section of the porous sheet 30A shown in FIG. 2A and FIG. 2B may be a cross section of the side on which the object to be kept warm or the like is placed, for example.

As shown in FIGS. 2A and 2B, the porous sheet 30A, that is made of a resin material having a melting point of 300° C. or higher, and that constitutes the outer covering member 30 of the tape heater 10 according to the present invention has a plurality of pores 300 formed in the planar direction of the sheet (Z-direction in the figure).

The porosity of the porous sheet 30A, that is made of a resin material having a melting point of 300° C. or higher, and that constitutes the outer covering member 30 of the tape heater 10 according to the present invention, varies, before and after the tape heater 10 is placed on an object and the tape heater 10 is used and heated. That is, in the porous sheet 30A that is made of a resin material having a melting point of 300° C. or higher and that constitutes the outer covering member 30, the porosity of the porous sheet 30A is lowered by heating of the heating element 20.

As mentioned above, the porous sheet 30A, that is made of a resin material having a melting point of 300° C. or higher, and that constitutes the outer covering member 30 of the tape heater 10 according to the present invention has a plurality of pores. By application of heat from the outside, the porosity of the porous sheet 30A is reduced, and the pores in the porous sheet 30A change such that the pores are filled. As a result, the tape heater is retained in a state that has been fitted to the shape of the object. This means that the tape heater is hardly detached from the object.

Such a porous sheet 30A is in the state of a porous sheet 30A having a high porosity when being placed. Therefore, flexibility of the porous sheet 30A is high, and deformation in conformity with the contours of an object can be attained easily. After placing in a prescribed shape to conform to the contours of the object, by exposing to heat from the heating element 20, the porous sheet 30A itself shrinks, whereby the porosity is lowered.

The porous sheet 30A of which the porosity has been reduced has flexibility lower than that before exposure to heat from the heating element 20, and is retained in a state that has been fitted to the shape of an object. As a result, the porous sheet 30A after being placed (after exposure to heat from the heating element 20) can easily retain the state in which the shape thereof has been deformed in conformity to the shape of the object.

More specifically, as shown in FIG. 4, the porous sheet 30A after being placed (after exposure to heat from the heating element 20) easily retains a state in which it is wound around the pipe (straight pipe) as the object, since the porosity thereof is lowered by heat generated by the heating element 20 in a state in which it is wound around a pipe (straight pipe) as an object, and as a result, the flexibility thereof is changed.

The tape heater 10 may be hardly detached from the pipe (straight pipe) as an object by becoming rigid in a shape conforming to the contours of the pipe (straight pipe) as the object, since the porosity thereof is lowered by heat generated by the heating element 20 in a state in which it is wound around a pipe (straight pipe) as an object, and as a result, the properties thereof are changed to have rigidity.

The tape heater 10 that is placed in a state that is fitted to the shape of the pipe (straight pipe) as an object keeps the object warm or the like without fail.

For example, the porosity of the porous sheet 30A that constitutes the outer covering member 30 of the tape heater 10 according to the present invention may be 50% or more. Due to a 50% or more of the porosity, the porous sheet 30A has excellent flexibility. The porosity of the porous sheet 30A may preferably be 60% or more, particularly preferably 70% or more. The upper limit of the porosity of the porous sheet 30A constituting the outer covering member 30 of the tape heater 10 according to the present invention is not particularly limited as long as the shape of the sheet is retained, but it may be 80% or less, for example.

The porosity after heating of the porous sheet 30A constituting the outer covering member 30 of the tape heater 10 according to the present invention may be smaller than the porosity before heating as explained above. For example, the porosity after heating of the porous sheet 30A of the outer covering member 30 of the tape heater 10 according to the present invention may be smaller than the porosity before heating and the porosity may be 40 to 70%. Due to reduction in porosity after heating as compared with the porosity before heating, the porous sheet 30A after heating has lower flexibility or becomes rigid as compared with the porous sheet 30A before heating, whereby it retains the shape that has been fitted to the shape of the object.

As for the heating temperature required to change (lower) the porosity of the porous sheet 30A, a specific temperature cannot be determined unconditionally since it varies depending on the type of a resin material for forming the porous sheet 30A or the method for forming pores. For example, the porosity of the porous sheet 30A constituting the outer covering member 30A of the tape heater 10 according to the present invention after heating the porous sheet 30A to 200° C. or higher may be smaller than the porosity of the porous sheet 30A before heating.

The porosity of the porous sheet 30A constituting the outer covering member 30 of the tape heater 30 according to the present invention after heating the porous sheet 30A to 200° C. or higher may be smaller than the porosity of the porous sheet 30A before heating and may be 40 to 70%.

The porosity of the porous sheet 30A constituting the outer covering member 30A of the tape heater 10 according to the present invention after heating the porous sheet 30A to 100° C. or higher may be smaller than the porosity of the porous sheet 30A before heating. The porosity of the porous sheet 30A constituting the outer covering member 30 of the tape heater 30 according to the present invention after heating the porous sheet 30A to 100° C. or higher may be smaller than the porosity of the porous sheet 30A before heating and may be 40 to 70%.

Here, the porosity is measured by the following method. As the test sample used for measuring the porosity, any of the following is prepared: (i) a sheet-like test piece of 1500 mm×1500 mm or (ii) a test piece obtained by punching to have a diameter of 47 mm.

The mass of each of the prepared test pieces is measured with a scale. In addition, as for the test sample in (i) mentioned above, the length, width and thickness thereof are measured with calipers, a steel measuring tape or a micrometer. As for the test sample in (ii) mentioned above, the diameter and thickness of a test piece obtained by punching to have a diameter of 47 mm are measured with calipers, a steel measuring tape or a micrometer.

As for the thickness of the sheet as the test sample in (i) mentioned above and the thickness of the test sample in (ii) mentioned above are taken as an average value of the measurement values at 25 locations. The length and width of the sheet as the test sample in (i) mentioned above and the diameter of the test sample in (ii) mentioned above are taken as an average value of the measurement values at 3 locations.

The porosity of the test sample in (i) mentioned above is a value obtained by calculation conducted by using the following formula (I) and measurement values. The porosity of the test sample in (ii) mentioned above is a value obtained by calculation conducted by using the following formula (II) and measurement values.

$$H = \left(1 - \frac{M \times 1000}{D \times W_1 \times W_2 \times t}\right) \times 100 \quad \text{(I)}$$

In the above formula (I), H is porosity (%), M is mass (g), $W_1$ is a length (mm) of one side (longitudinal side), $W_2$ is a length (mm) of one side (lateral side) and t is a thickness (mm). In the formula, D is a density (g/cm$^3$) of a material forming a test sample (i.e. a material forming the second shaped body 30A). For example, when it is formed of PTFE, the density is 2.17 (g/cm$^3$).

$$H = \left(1 - \frac{M \times 1000}{D \times \frac{3.14 \times d^2}{4} \times t}\right) \times 100 \quad \text{(II)}$$

In the above formula (II), H is porosity (%), M is mass (g), d is (mm) and t is thickness (mm). In the formula, D is a density (g/cm$^3$) of a material forming a test sample (i.e. a material forming the second shaped body 30A). For example, when it is formed of PTFE, the density is 2.17 (g/cm$^3$).

Further, the porous sheet 30A may be formed by stretching a resin sheet to form a plurality of pores. Also, the porous sheet 30A may be formed by stretching a resin sheet in multiple directions to form a plurality of pores. Also, the porous sheet 30A may be formed by biaxial stretching a resin sheet to form a plurality of pores.

The porous sheet 30A in which a plurality of pores are formed by stretching is shrunk in the direction of stretching, when shrinking by heating. Therefore, the porous sheet 30A that is stretched in multiple directions (for example, the porous sheet 30A that is subjected to biaxial stretching) shrinks uniformly as compared with the porous sheet 30A that is subjected to uniaxial (unidirectional) stretching. The thus shrunk porous sheet 30A is placed in adjacent to the object more closely, whereby the advantageous effects of the present invention can be further enhanced.

Further, the porous sheet 30A may be formed by stretching a resin sheet with heating to form a plurality of pores. As a result, a plurality of pores formed in the porous sheet 30A hardly shrink by heating. That is, by stretching with heating the porous sheet 30A at a prescribed temperature, the amount of shrinkage of the porous sheet 30A can be adjusted.

For example, the porous sheet 30A may be formed by stretching a resin sheet at normal temperature (0 to 30° C.) to form a plurality of pores. Further, the porous sheet 30A may be formed by stretching with heating a resin sheet at 300 to 400° C. to form a plurality of pores.

It is assumed that the porous sheet 30A in which a plurality of pores are formed by stretching a sheet made from a resin material is in a state where stress is applied to the inside thereof by the stretching. In such a state in which stress is exerted to the inside thereof, if heat is applied from the outside, the porous sheet 30A acts to fill the pores formed by stretching by the so-called stress relaxation, and as a result, the pore diameter of the porous sheet 30A is reduced.

As mentioned above, the degree of amount of shrinkage of the porous sheet 30A can be adjusted by heating at the time of stretching, and the direction of shrinkage can be adjusted by controlling the direction of stretching. Therefore, it is possible to control the pore diameter for forming an optimum porous sheet that retains a state that has been fitted to the shape of an object to be heated.

Also, the pore diameter of the porous sheet 30A constituting the outer covering member 30 of the tape heater 10 according to the present invention may be, for example, 200 μm or less, in order to provide for gas permeability and liquid impermeability. The porous diameter of the porous sheet 30A constituting the outer covering member 30 of the tape heater 10 according to the present invention may be 100 μm or less.

The lower limit of the pore diameter of the porous sheet 30A constituting the outer covering member 30 of the tape heater 10 according to the present invention is not particularly limited, but it may be, for example, 1 μm or more, or 5 μm or more.

The pore diameter after heating of the porous sheet 30A constituting the outer covering member 30 of the tape heater 10 according to the present invention is smaller than the pore diameter before heating. As for the mechanism for allowing the pore diameter of the porous sheet 30A after heating to be smaller than the pore diameter before heating, the pore diameter may be reduced by utilizing stress relaxation as mentioned above. Alternatively, for example, a material itself constituting the porous sheet 30A expands to fill the pores, as a result, the pore diameter may be reduced.

The thickness of the porous sheet 30A constituting the outer covering member 30 of the tape heater 10 according to the present invention may be 0.5 to 3 mm, for example. Due to the thickness of 0.5 to 3 mm of the porous sheet 30A, placement of the sheet on an object is facilitated. The thickness of the porous sheet 30A may be 0.5 to 2 mm, or 0.5 to 1.5 mm, for example.

The porous sheet 30A may be made of a fluororesin, for example. By forming the porous sheet 30A by using a fluororesin, an excellent heat resistance is imparted, and in addition, properties such as resistance to chemicals and resistance to solvents are imparted. It is preferred that the porous sheet 30A be formed of a fluorine-containing polymer such as PTFE (polytetrafluoroethylene), PFT (tetrafluoroethylene-perfluoroalkoxyethylene copolymer) and FEP (tetrafluoroethylene-hexafluoropropylene copolymer). PCTFE (polychlorotrifluoroethylene), ETFE (tetrafluoroethylene-ethylene copolymer), ECTFE (chlorotrifluoroethylene-ethylene copolymer), PVDF (polyvinylidene fluoride) or the like can be used. The porous sheet 30A may be made of PTFE.

When the porous sheet 30A is made of polytetrafluoroethylene, the polytetrafluoroethylene may be uncalcined polytetrafluoroethylene. In other words, uncalcined polytetrafluoroethylene may be polytetrafluoroethylene having a plurality of peaks derived from thermal energy absorption of the polytetrafluoroethylene detected when the polytetrafluoroethylene is molten in a differential scanning calorimetry (DSC) measurement.

Hereinbelow, a more specific explanation will be given along with a differential scanning calorimetry (DSC) measurement method, whether polytetrafluoroethylene has a plurality of peaks derived from thermal energy absorption.

The differential scanning calorimetry (DSC) measurement is conducted by means of a differential scanning calorimeter (DSC-60A: manufactured by Shimadzu Corporation). A sample to be measured is molten by heating it at a temperature elevation speed of 10° C./min to 400° C. The melting point and the number of melt peaks that occur when the sample is molten are measured.

Polytetrafluoroethylene is a crystalline polymer. For example, fine powder of polytetrafluoroethylene (raw material) produced by emulsion polymerization has a highly-crystallized state with a high crystallization degree (e.g. high crystallization degree: 80% or more). The melting point thereof exceeds 337° C.

When this fine powder of polytetrafluoroethylene (raw material) is molten (calcined) completely, the crystallization degree is lowered (for example, crystallization degree of about 30 to 70%), and the melting point (a peak derived from absorption of thermal energy in the DSC measurement) is shifted to a range of 327±10° C., and is detected as a single peak in the temperature range.

On the other hand, in the differential scanning calorimetry (DSC) measurement results of uncalcined polytetrafluoroethylene, the melting point (a peak derived from thermal absorption in the DSC measurement) is detected at two locations; i.e. a range of 327° C.±10° C. and a range exceeding 337° C.

That is, the porous sheet 30A formed of uncalcined polytetrafluoroethylene has un-molten parts in its structure, and these parts differ in crystallization degree. As a result, in the differential scanning calorimetry (DSC) measurement results, a plurality of peaks derived from absorption of thermal energy are measured.

The crystallization degree before melting (calcination) is larger than the crystallization degree after melting. This means that, in the porous sheet 30A formed of uncalcined polytetrefluoroethylene, polymers having different crystallization degrees are present in a mixed state in the porous sheet 30A.

When the porous sheet 30A formed of uncalcined polytetrafluoroethylene in which the crystallization degree differs from part to part is exposed to heat, in order to homogenize the crystallization degree in the structure, a structural change is more accelerated within the porous sheet 30A, whereby the degree of shrinkage of pores is enhanced. As a result, it is preferred that, when the porous sheet 30A formed of uncalcined polytetrafluoroethylene is exposed to heat, the porous sheet 30A be retained in a state that has been fitted to the shape of the object to be heated.

Further, as shown in FIG. 1, the porous sheet 30A constituting the outer covering member 30 may envelop the heating element 20 in its inside by folding the sheet. Alternatively, two sheets of the porous sheet 30A are prepared, and the heating element 20 may be enveloped by being disposed between these sheets.

The ends of the porous sheet 30A constituting the outer covering member 30 may be joined by sewing, thermal welding, adhesion or the like. Alternatively, the ends may be stapled by means of a stapler. In the embodiments explained below, the ends of the porous sheet 30A constituting the outer covering member 30 are joined by sewing.

In the heating system in which the tape heater as mentioned above is placed on an object, the tape heater deforms its shape to conform to the contours of the object and hence can be placed in adjacent to the object easily. In addition, after being placed on the object, the tape heater changes its shape that has been deformed to conform to the contours of the object as little as possible.

That is, provided is a heating system comprising:

a tape heater that comprises a heating element and an outer covering member that envelops and accommodates the heating element and that is composed of a porous sheet made of a resin material having a melting point of 300° C. or higher, and an object that is kept warm and heated by the tape heater, wherein the tape heater is provided such that, after being provided on the object to conform to contours of the object, a shape of the outer covering member, that has been deformed to conform to the contours of the object, is retained by heat generated by the heating element provided in the tape heater.

Hereinbelow, various embodiments of the tape heater 10 according to the present invention will be explained. However, the tape heater 10 according to the present invention is not limited to the following embodiment.

First Embodiment

Figure 3A:
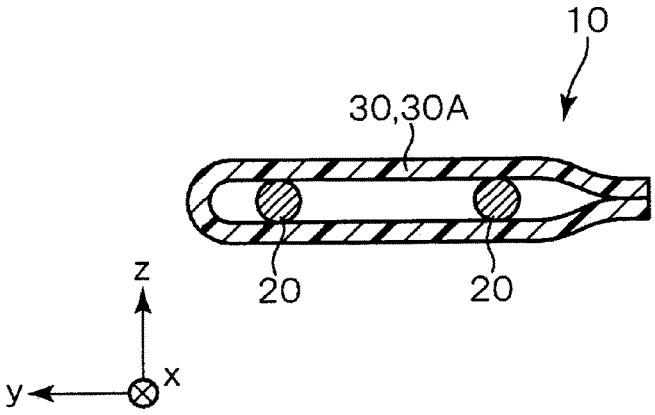
FIG. 3A is a view showing one example of the cross section taken along line III-III in FIG. 1.

FIG. 3A is a view showing one example of the cross section taken along line III-III in FIG. 1. As shown in FIG. 3A, the electric heater wire that the parts thereof are arranged side by side by making a U-turn is provided such that they are apart from each other so that they do not contact with each other. For example, the electric heater wire shown in FIG. 3A may be directly fixed to the porous sheet 30A made of a resin material as the outer covering member 30.

Second Embodiment

Figure 3B:
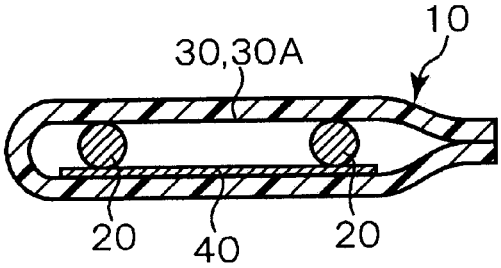
FIG. 3B is a view showing another example of the cross section taken along line III-III in FIG. 1.

FIG. 3B is a view showing another example of the cross section taken along line III-Ill shown in FIG. 1. As shown in FIG. 3B, the electric heater wire that the parts thereof are arranged side by side by making a U-turn is provided such that they are apart from each other so that they do not contact with each other. Therefore, the tape heater 10 according to the second embodiment is configured to further include a substrate 40 that supports the electric heater wire.

The substrate 40 is a substrate 40 that supports an electric heater wire. Therefore, it may be preferably formed of a material being excellent in heat insulating properties in addition to heat resistance and flexibility. As examples of such material, fibrous fabrics and non-woven fabrics made of a heat resistant organic material, for example, a fluororesin such as PTFE, PFT, FEP, PCTFE, ETFE, ECTFE and PVdF; aramid resin, polyamide, polyimide, polycarbonate, polyacetal, polybutylene terephthalate, modified polyphenylene ether, polyphenylene sulfide, polysulfone, polyether sulfone, polyarylate and polyether ether ketone; or an inorganic material such as glass, ceramics and silica can be given. The material is appropriately selected and used in accordance with a temperature at which the object is kept warm or heated. The materials may be used in a mixture. If they have flexibility, a sheet as a continuous body of each material can also be used.

The dimension of the substrate 40 is not particularly limited. Normally, the thickness is about 0.5 to 3.0 mm, the width is about 10 to 50 mm, and the length is about 500 to 1000 mm. According to need, the substrate 40 may be thicker or thinner, wider or narrower, or longer or shorter. If necessary, two or more substrates 40 may be used by staking one on another.

The method for allowing the electric heater wire 40 to be supported by the substrate 40 is not particularly restricted. A method in which the electric heater wire and a substrate part that supports the electric heater wire are sewn by roll sewing by using thin heat-resistant fibers such as glass yarn, silica yarn, alumina yarn and those obtained by coating them with a fluororesin, or threads, or a metal wire; a method in which an electric heater wired part is bonded to the substrate by pushing with a mesh-like sheet; a method in which the electric heater wire itself is sewn by means of a sewing machine or other methods can be given. At this time, it is preferred that the electric heater wire be covered by a heat resistant material as little as possible in respect of heat efficiency.

Third Embodiment

Figure 3C:
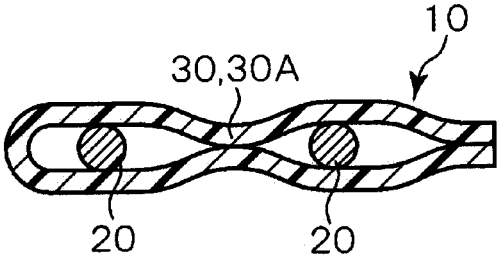
FIG. 3C is a view showing another example of the cross section taken along line III-III in FIG. 1.

FIG. 3C is a view showing another example of the cross section taken along line III-III in FIG. 1. As shown in FIG. 3C, the electric heater wire that the parts thereof are arranged side by side by making a U-turn has a configuration in which the outer covering members 30 are joined between the parts of the electric heater wire such that they do not contact with each other.

Joining of the outer covering members 30 between the electric heater wire in this embodiment may be conducted by sewing, thermal welding, adhesion or the like. The outer covering members 30 between the electric heater wire in this embodiment may be stapled by means of a stapler. In this embodiment, the outer covering members 30 between the electric heater wire are joined by sewing.

Fourth Embodiment

Figure 3D:
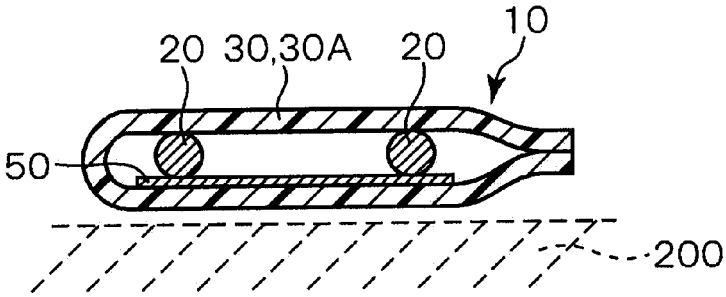
FIG. 3D is a view showing another example of the cross section taken along line III-III in FIG. 1.

FIG. 3D is a view showing another example of the cross section taken along line III-III in FIG. 1. As shown in FIG. 3D, the electric heater wire that the parts thereof are arranged side by side by making a U-turn is provided such that they are apart from each other so that they do not contact with each other. In addition, for example, on the side where the object 200 to be heated or the like by the electric heater wire is placed, a metal thin film 50 is provided.

The metal thin film 50 provided in this embodiment has excellent heat conductivity. Due to the provision of the metal thin film 50 having excellent heat conductivity, heat generated by the heater is distributed more uniformly on the heating side of the tape heater 10, whereby the object to be heated or the like can be heated or the like uniformly. Provision of the metal thin film 50 results in application of heat uniformly to the porous sheet 30A as the outer covering member 30. As a result, advantageous effects are brought about that the entire surface of the heating side of the tape heater 10 is brought into a state that has been fitted to the shape of the object to be heated.

The metal thin film 50 may be formed of aluminum, for example. In order to prevent tearing, the metal thin film 50 may be reinforced by allowing it to have a stacked structure in which a heat-resistant film or the like is stacked, if necessary. In this case, it is preferred that the heat-resistant film be as thin as possible.

The thickness of the metal thin film 50 may be 20 μm to 5 mm, for example. By allowing the thickness of the metal thin film 50 to be 20 μm to 5 mm, effects that the heat generated by the heater is distributed more uniformly on the heating side surface of the tape heater 10 can be exhibited more significantly. The thickness of the metal thin film 50 that constitutes the tape heater 10 according to the present invention may be 30 μm to 100 μm, or 40 μm to 70 μm, for example.

Fifth Embodiment

Figure 3E:
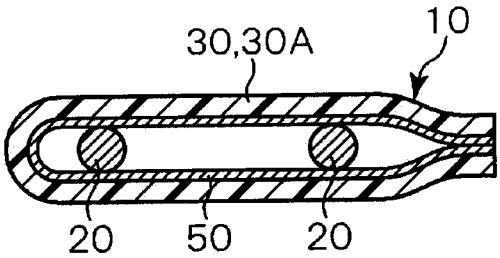
FIG. 3E is a view showing another example of the cross section taken along line III-III in FIG. 1.

FIG. 3E is a view showing another example of the cross section taken along line III-III in FIG. 1. In the tape heater 10 shown in FIG. 3E, the metal thin film 50 provided in the tape heater 10 in the fourth embodiment is further provided on the side opposite to the side where the object to be heated or the like by the electric heater wire is provided. That is, in the fifth embodiment, the metal thin film 50 is provided between an object provision side of the heating element 20 and the porous sheet 30A, and between the side opposite to the object provision side of the heating element 20 and the porous sheet 30A.

In the tape heater 10 according to the fifth embodiment, on the entire surface of the porous sheet 30A of the side that envelops and accommodates the heating element 20, the metal thin film 50 provided between the porous sheet 30A and the heating element 20 may further be included.

Due to the provision of the metal thin film 50 on the entire inner surface of the porous sheet 30A as mentioned above, an advantageous effect is brought about that, by using the tape heater 10 (heat generation of the heating element 20), the outer covering member 30 can be uniformly, over the entire surface thereof, in a state that is fitted to the shape of the object to be heated. Further, due to provision of the metal thin film 50 on the entire inner surface of the porous sheet 30A, an advantageous effect is brought about that, if a pollutant such as dust and outgas is generated in the inside of the tape heater 10, release of the outgas to the outside of the tape heater 10 can be suppressed.

Sixth Embodiment

Figure 3F:
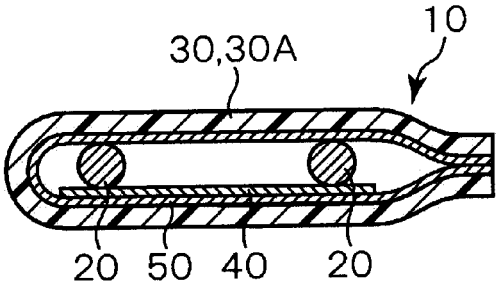
FIG. 3F is a view showing another example of the cross section taken along line III-III in FIG. 1.

FIG. 3F is a view showing another example of the cross section taken along line III-III in FIG. 1. The tape heater 10 shown in FIG. 3F is one in which the tape heater 10 of the fifth embodiment further includes the substrate 40 provided in the tape heater 10 in the third embodiment.

The tape heater 10 according to the sixth embodiment realizes the following; i.e. when being placed on an object, the tape heater is flexible in order to deform itself to conform to the shape of the object, and after being placed on the object, it is in a state that has been fitted to the shape of the object such that the state of placement is not changed. Further, due to provision of the metal thin film 50 on the entire inner surface of the porous sheet 30A, by the use of the tape heater 10 (heat generation of the heating element 20), the entire outer covering member 30 is brought into a state that has been fitted to the shape of the object to be heated, and as a result, the advantageous effects of the present invention are further enhanced.

Further, due to the provision of the metal thin film 50 between an object provision side of the heating element 20 and the porous sheet 30A, and between the side opposite to the object provision side of the heating element 20 and the porous sheet 30A, or due to the provision of the metal thin film 50 on the entire inner surface of the porous sheet 30A, an advantageous effect is brought about that, if a pollutant such as dust and outgas is generated in the inside of the tape heater 10, release of the outgas to the outside of the tape heater 10 can be suppressed.

Seventh Embodiment

Figure 3G:
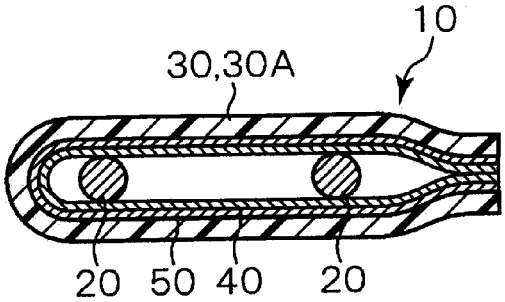
FIG. 3G is a view showing another example of the cross section taken along line III-III in FIG. 1.

FIG. 3G is a view showing another example of the cross section taken along line III-III in FIG. 1. The tape heater 10 shown in FIG. 3G is one in which the substrate 40 of the tape heater 10 of the sixth embodiment is provided on the entire inner surface of the metal thin film 50.

As mentioned above, due to the provision of the metal thin film 50 between an object provision side of the heating element 20 and the porous sheet 30A, and between the side opposite to the object provision side of the heating element 20 and the porous sheet 30A, or due to the provision of the metal thin film 50 on the entire inner surface of the porous sheet 30A, fixing of an electric heater wire as the heating element 20 can be ensured, whereby advantageous effects that the entire outer covering member 30 is brought into a state that has been fitted to the shape of the object by the use of the tape heater 10 (heat generation of the heating element 20), and advantageous effects that, if a pollutant such as dust and outgas is generated in the inside of the tape heater 10, release of the outgas to the outside of the tape heater 10 is suppressed are further enhanced.

EXPLANATION OF REFERENTIAL NUMERALS

10 Tape heater
20 Heating element
30 Outer covering member
30A Porous sheet
40 Substrate
50 Thin film
200 Object
300 Pore

The invention claimed is:

1. A tape heater comprising:

a substrate including deformable two layers which have a belt-like shape;

an electric heater wire fixed to the substrate, the electric heater wire being disposed between the layers; and an outer covering member that envelops the belt-shaped substrate and includes a deformable porous sheet made of a resin material having a melting point of 300° C. or higher.

2. The tape heater according to claim 1, wherein the porous sheet is configured to be hardened or stiffened by heat generated by the electric heater wire.

3. The tape heater according to claim 1, wherein the porous sheet is formed by stretching a resin sheet to form a plurality of pores.

4. The tape heater according to claim 1, wherein the porous sheet has a pore diameter of 1 to 100 μm.

5. The tape heater according to claim 1, wherein the porous sheet has a porosity of 50 to 80%.

6. The tape heater according to claim 1, wherein the resin material includes polytetrafluoroethylene.

7. The tape heater according to claim 1, further comprising a metal thin film provided between the substrate and the outer covering member.

* * * * *